US009348297B2

(12) United States Patent
Gondoh et al.

(10) Patent No.: US 9,348,297 B2
(45) Date of Patent: May 24, 2016

(54) IMAGE FORMING APPARATUS AND PROCESS CARTRIDGE

(71) Applicants: Masanobu Gondoh, Kanagawa (JP); Shinji Nohsho, Tokyo (JP); Shohei Gohda, Kanagawa (JP); Kaori Toyama, Kanagawa (JP); Masahiro Ohmori, Kanagawa (JP); Yohta Sakon, Kanagawa (JP); Ichiro Maeda, Kanagawa (JP); Takeshi Tada, Kanagawa (JP); Takayuki Gotoh, Kanagawa (JP)

(72) Inventors: Masanobu Gondoh, Kanagawa (JP); Shinji Nohsho, Tokyo (JP); Shohei Gohda, Kanagawa (JP); Kaori Toyama, Kanagawa (JP); Masahiro Ohmori, Kanagawa (JP); Yohta Sakon, Kanagawa (JP); Ichiro Maeda, Kanagawa (JP); Takeshi Tada, Kanagawa (JP); Takayuki Gotoh, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/284,846

(22) Filed: May 22, 2014

(65) Prior Publication Data

US 2014/0356042 A1 Dec. 4, 2014

(30) Foreign Application Priority Data

May 30, 2013 (JP) ..... 2013-114415

(51) Int. Cl.
*G03G 21/10* (2006.01)
*G03G 21/00* (2006.01)

(52) U.S. Cl.
CPC ..... *G03G 21/0011* (2013.01); *G03G 21/0017* (2013.01)

(58) Field of Classification Search
CPC ..... G03G 21/0011; G03G 21/0017
See application file for complete search history.

(56) References Cited

U.S. PATENT DOCUMENTS

| | | | | |
|---|---|---|---|---|
| 2006/0285898 | A1* | 12/2006 | Watanabe et al. | 399/350 |
| 2008/0080914 | A1* | 4/2008 | Sugimoto | 399/350 |
| 2011/0135361 | A1 | 6/2011 | Kabata et al. | |
| 2011/0217102 | A1* | 9/2011 | Ohmori et al. | 399/350 |
| 2012/0063826 | A1 | 3/2012 | Ohmori et al. | |
| 2013/0243507 | A1 | 9/2013 | Sakon et al. | |

FOREIGN PATENT DOCUMENTS

| | | | |
|---|---|---|---|
| JP | 2009-300754 | | 12/2009 |
| JP | 2009300754 A | * | 12/2009 |

* cited by examiner

*Primary Examiner* — David Gray
*Assistant Examiner* — Michael Harrison
(74) *Attorney, Agent, or Firm* — Harness, Dickey & Pierce

(57) ABSTRACT

An image forming apparatus includes an image carrier, a charging mechanism to charge a surface of the image carrier, an electrostatic latent image forming mechanism to form an electrostatic latent image on the surface of the image carrier, a developing mechanism to develop the electrostatic latent image formed on the surface of the image carrier into a toner image, a transfer mechanism to transfer the toner image on the surface of the image carrier to a transfer body, and a cleaning mechanism including a cleaning blade to clean a transfer residue toner adhering to the surface of the image carrier by contacting the surface of the image carrier. The cleaning blade includes a strip shaped elastic blade and a surface layer formed on an opposing surface of the strip shaped elastic blade opposite the surface of the image carrier.

10 Claims, 5 Drawing Sheets

IMAGE FORMING APPARATUS AND PROCESS CARTRIDGE

CROSS-REFERENCE TO RELATED APPLICATIONS

This patent application is based on and claims priority pursuant to 35 U.S.C. §119 from Japanese Patent Application No. 2013-114415, filed on May 30, 2013 in the Japan Patent Office, which is hereby incorporated by reference herein in its entirety.

BACKGROUND

1. Technical Field

Exemplary embodiments of the present disclosure generally relate to an image forming apparatus such as a copier, a facsimile machine, or a printer, and a process cartridge detachably attached with respect to the image forming apparatus.

2. Description of the Related Art

In conventional electrophotographic image forming apparatuses, after a toner image is transferred to an intermediate transfer body or a transfer sheet, an unnecessary transfer residue toner adhering to a surface of an image carrier such as a photoreceptor serving as a cleaning target member is removed by a cleaning device serving as a cleaning mechanism. A configuration of a cleaning member of the cleaning device is typically simple. From a point of good cleaning performance, employing a strip shaped cleaning blade is well known. The strip shaped cleaning blade is formed of a strip shaped elastic body such as polyurethane rubber. A base end of the strip shaped cleaning blade is supported by a supporting member and a leading-edge ridge line portion of the strip shaped cleaning blade is pressed against an outer circumferential surface of the image carrier from a direction counter to a direction of movement of the outer circumferential surface of the image carrier. The transfer residue toner on surface of the image carrier is removed by stopping and scraping off with the strip shaped cleaning blade.

To respond to a demand of high image quality of recent years, employing an image forming apparatus using a toner (hereinafter referred to as polymerized toner) having a small particle diameter and a shape close to a sphere formed by, for example, a polymerization method is well known. The polymerized toner has a high transfer efficiency compared to a conventional pulverized toner and meeting the above-described demand is possible. However, sufficient removal of the polymerized toner from the surface of the image carrier with the strip shaped cleaning blade is difficult and a problem of cleaning failure is generated. The generation of cleaning failure is due to the polymerized toner having the small particle diameter and a good spheroidicity slipping through a slight space formed between the strip shaped cleaning blade and the surface of the image carrier.

To suppress slipping through of the polymerized toner, there is a need to enhance a contact pressure between the strip shaped cleaning blade and the surface of the image carrier and enhance cleaning performance cleaning blade. However, as shown in FIG. 7A, when the contact pressure is enhanced, a friction force between a conventional cleaning blade 262 and a surface of an image carrier 23 is enhanced and the conventional cleaning blade 262 is drawn towards a moving direction of the image carrier 23 indicated by arrow D in FIG. 7A. Accordingly, curling of a leading-edge ridge line portion 262*c* of the conventional cleaning blade 262 occurs. The conventional cleaning blade 262 may generate an abnormal sound due trying to return to an original state of the conventional cleaning blade 262 in resistance to curling. Repetition of curling and returning to the original state generates a chattering vibration. In addition, as shown in FIG. 7B, when cleaning is continued in a state in which the leading-edge ridge line portion 262*c* of the conventional cleaning blade 262 is curled, local wear is generated at a point a few μm away from the leading-edge ridge line portion 262*c* on a leading-edge surface 262*a* extending from the leading-edge ridge line portion 262*c* in a direction of thickness of the conventional cleaning blade 262. When cleaning is further continued with the above-described state, local wear becomes large and eventually the leading-edge ridge line portion 262*c* and a vicinity of the leading-edge ridge line portion 262*c* including a part of the leading-edge surface 262*a* and a part of an opposing surface 262*b* is lost as shown in FIG. 7C. When the leading-edge ridge line portion 262*c* is lost, normal cleaning of the polymerized toner is not possible and cleaning failure is generated.

JP-2009-300754-A describes an image forming apparatus including a cleaning blade including a surface layer provided on an opposing surface opposite a surface of an image carrier in which a layer thickness becomes thicker as a distance from a leading-edge ridge line portion of the cleaning blade increases in a direction at a downstream side of a movement of the surface of the image carrier. In the image forming apparatus described in JP-2009-300754-A, an elastic blade of the cleaning blade contacts the surface of the image carrier with an initial contact width between the cleaning blade and the surface of the image carrier in a range from 30 μm or more to 80 μm or less. In addition, the image forming apparatus described in JP-2009-300754-A includes a lubricant coating device to coat a lubricant on the surface of the image carrier. By coating the lubricant on the surface of the image carrier, friction coefficient between the cleaning blade and the surface of the image carrier is decreased.

By providing the surface layer that is harder than the elastic blade on the opposing surface of the elastic blade, rigidity in the direction of the movement of the surface of the image carrier may be enhanced and curling of the leading-edge ridge line portion may be suppressed. In addition, by making the layer thickness of the surface layer become thicker as the distance from the leading-edge ridge line portion of the cleaning blade increases, the vicinity of the leading-edge ridge line portion is suppressed from becoming too rigid due to the surface layer. Accordingly, the leading-edge ridge line portion follows fluctuation such as decentering of a normal line direction of the surface of the image carrier and good cleanability is obtained. By making the initial contact width 30 μm or more, the contact pressure between the leading-edge ridge line portion of the cleaning blade and the image carrier is suppressed from becoming high and friction force between the leading-edge ridge line portion of the cleaning blade and the image carrier is suppressed from becoming high. As a result, force of drawing in the leading-edge ridge line portion of the cleaning blade in the direction of the movement of the surface of the image carrier is suppressed from becoming strong and curling of the leading-edge ridge line portion is suppressed. Further, by making the initial contact width 80 μm or less, reaching a wear width at an early stage in which cleaning failure is generated is suppressed.

However, in recent years, a further long operation life of the cleaning blade is desired and narrowing the initial contact width is needed. The narrower the initial contact width is, a time to reach the wear width in which cleaning failure is generated becomes longer and a longer operation life of the cleaning blade may be obtained.

SUMMARY

In view of the foregoing, in an aspect of this disclosure, there is provided a novel image forming apparatus including an image carrier, a charging mechanism to charge a surface of the image carrier, an electrostatic latent image forming mechanism to form an electrostatic latent image on the surface of the image carrier, a developing mechanism to develop the electrostatic latent image formed on the surface of the image carrier into a toner image, a transfer mechanism to transfer the toner image on the surface of the image carrier to a transfer body, and a cleaning mechanism including a cleaning blade to clean a transfer residue toner adhering to the surface of the image carrier by contacting the surface of the image carrier. The cleaning blade includes a strip shaped elastic blade and a surface layer formed on an opposing surface of the strip shaped elastic blade opposite the surface of the image carrier. The surface layer has a hardness harder than the strip shaped elastic blade and a layer thickness becoming thicker as a distance from a leading-edge ridge line portion of the strip shaped elastic blade increases, and is formed up to the leading-edge ridge line portion. The leading-edge ridge line portion of the cleaning blade contacts the surface of the image carrier with an initial contact width between the cleaning blade and the surface of the image carrier in a range from 12 μm or more to 30 μm or less.

In an aspect of this disclosure, there is provided an image forming apparatus including an image carrier, a charging mechanism to charge a surface of the image carrier, an electrostatic latent image forming mechanism to form an electrostatic latent image on the surface of the image carrier, a developing mechanism to develop the electrostatic latent image formed on the surface of the image carrier into a toner image, a transfer mechanism to transfer the toner image on the surface of the image carrier to a transfer body, and a cleaning mechanism including a cleaning blade to clean a transfer residue toner adhering to the surface of the image carrier by contacting the surface of the image carrier. The cleaning blade includes a strip shaped elastic blade and a surface layer formed on an opposing surface of the strip shaped elastic blade, the opposing surface provided opposite the surface of the image carrier, and on a leading-edge surface, the leading-edge surface provided perpendicular to the opposing surface and sandwiches a leading-edge ridge line portion with the opposing surface. The surface layer having a hardness harder than the strip shaped elastic blade and a layer thickness becoming thicker as a distance from the leading-edge ridge line portion of the strip shaped elastic blade increases, and is formed up to the leading-edge ridge line portion. The leading-edge ridge line portion of the cleaning blade contacts the surface of the image carrier with an initial contact width between the cleaning blade and the surface of the image carrier in a range from 1 μm or more to 30 μm or less.

In an aspect of this disclosure, there is provided a process cartridge including an image carrier, and a cleaning mechanism including a cleaning blade to at least clean a transfer residue toner adhering to a surface of the image carrier. The process cartridge supports the image carrier and the cleaning mechanism as a single unit, and is detachably attached with respect to a body of an image forming apparatus. The cleaning blade includes a strip shaped elastic blade, and a surface layer formed on an opposing surface of the strip shaped elastic blade opposite the surface of the image carrier. The surface layer having a hardness harder than the strip shaped elastic blade and a layer thickness becoming thicker as a distance from a leading-edge ridge line portion of the strip shaped elastic blade increases, and is formed up to the leading-edge ridge line portion. The leading-edge ridge line portion of the cleaning blade contacts the surface of the image carrier with an initial contact width between the cleaning blade and the surface of the image carrier in a range from 12 μm or more to 30 μm or less.

In an aspect of this disclosure, there is provided a process cartridge including an image carrier, and a cleaning mechanism including a cleaning blade to at least clean a transfer residue toner adhering to a surface of the image carrier. The process cartridge supports the image carrier and the cleaning mechanism as a single unit, and is detachably attached with respect to a body of an image forming apparatus. The cleaning blade includes a strip shaped elastic blade, and a surface layer formed on an opposing surface of the strip shaped elastic blade, the opposing surface provided opposite the surface of the image carrier, and on a leading-edge surface, the leading-edge surface provided perpendicular to the opposing surface and sandwiches a leading-edge ridge line portion with the opposing surface. The surface layer having a hardness harder than the strip shaped elastic blade and a layer thickness becoming thicker as a distance from the leading-edge ridge line portion of the strip shaped elastic blade increases, and is formed up to the leading-edge ridge line portion. The leading-edge ridge line portion of the cleaning blade contacts the surface of the image carrier with an initial contact width between the cleaning blade and the surface of the image carrier in a range from 1 μm or more to 30 μm or less.

The aforementioned and other aspects, features, and advantages will be more fully apparent from the following detailed description of illustrative embodiments, the accompanying drawings, and associated claims.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
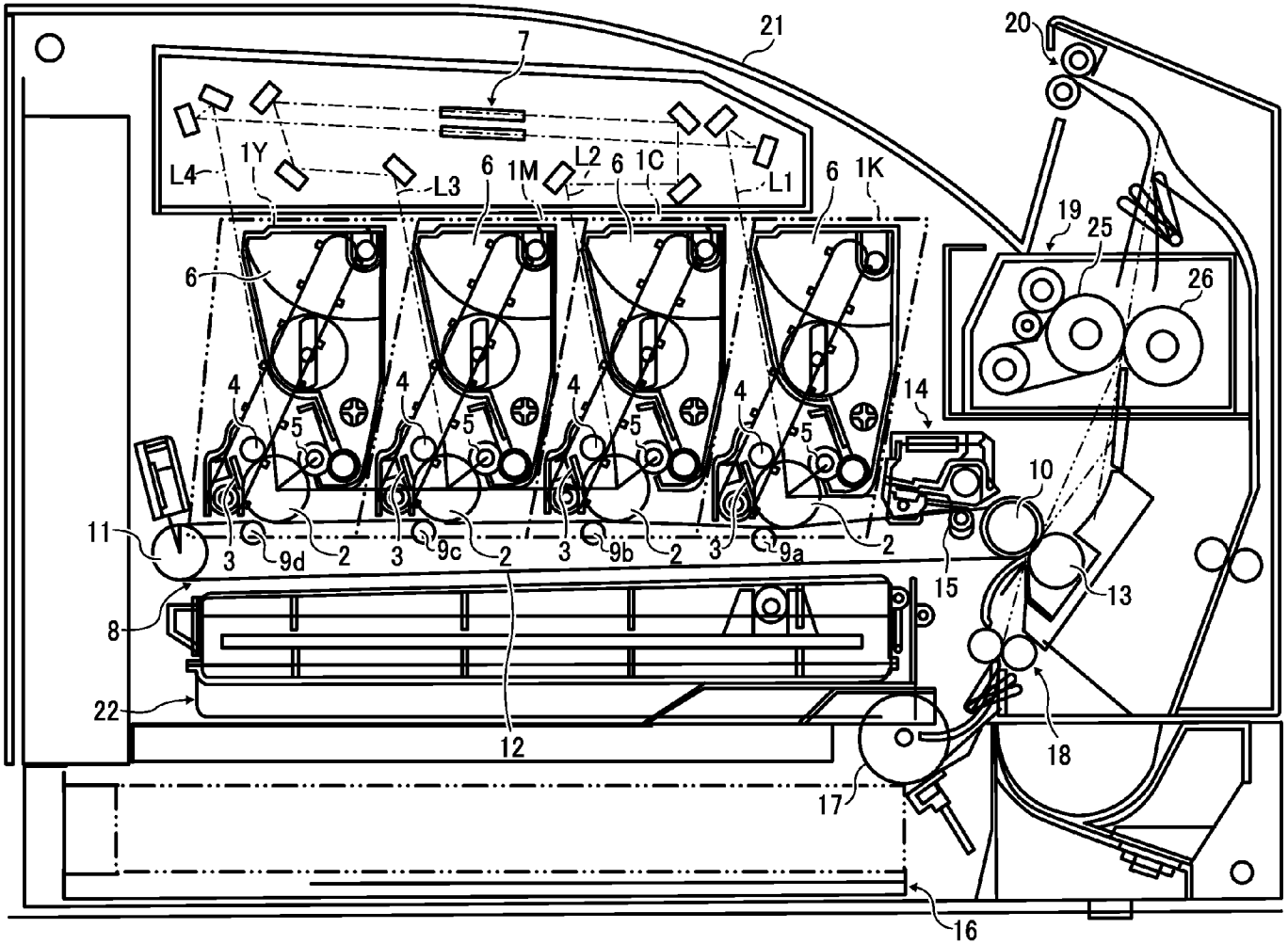
FIG. 1 is a schematic view of the image forming apparatus according to an embodiment of the present invention.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

Hereinafter, exemplary embodiments of the present invention are described in detail with reference to the drawings. However, the present invention is not limited to the exemplary embodiments described below, but can be modified and improved within the scope of the present invention.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In view of the foregoing, in an aspect of this disclosure, there is provided a novel image forming apparatus and process cartridge maintaining good cleanability over a time sufficiently long.

The following is a detailed description of an example of an electrophotographic printer (hereinafter simply referred to as printer) serving as the image forming apparatus according to an embodiment of the present invention. FIG. 1 is a schematic view of the image forming apparatus according to an embodiment of the present invention. The following is a description of main parts of the image forming apparatus with reference to FIG. 1.

The image forming apparatus includes an image forming unit including four process units 1K, 1C, 1M, and 1Y for forming an image employing developers of different colors of black, cyan, magenta, and yellow, respectively, corresponding to separated color components of an color image. Configuration of each process unit 1K, 1C, 1M, and 1Y is the same excluding color of a toner contained in each process unit 1K, 1C, 1M, and 1Y. For example, the configuration of one process unit 1K is as follows. The process unit 1K includes, an image carrier 2 (i.e., photoreceptor 2), a cleaning mechanism 3, a charging mechanism 4, a developing mechanism 5, and a toner storage section 6. The process unit 1K is detachably attached with respect to an image forming apparatus body. As shown in FIG. 1, an exposure unit 7 is provided above each process unit 1K, 1C, 1M, and 1Y. The exposure unit 7 is configured to emit a laser light L1 through L4 from a laser diode based upon an image data.

In addition, a transfer belt device 8 is provided below each process unit 1K, 1C, 1M, and 1Y. The transfer belt device 8 includes an intermediate transfer belt 12 for transferring a toner image formed on the image carrier 2. The intermediate transfer belt 12 is rotationally driven and is stretched around four primary transfer rollers 9*a*, 9*b*, 9*c*, and 9*d* opposite each image transfer roller 2 of each process unit 1K, 1C, 1M, and 1Y; a drive roller 10; a tension roller 11; and a cleaning backup roller 15. A drive roller 10 is provided opposite a secondary transfer roller 13, and a belt cleaning device 14 is provided opposite the cleaning backup roller 15.

A sheet feed cassette 16 capable of storing multiple sheets and a sheet feed roller 17 are provided at a lower section of the image forming apparatus. A pair of registration rollers 18 is provided along the way from the sheet feed roller 17 to a nip formed between the drive roller 10 and the secondary transfer roller 13, and temporarily stops a fed sheet.

A fixing device 19 incorporating, for example, a fixing roller 25 and a pressure roller 26 is provided above the nip formed between the drive roller 10 and the secondary transfer roller 13. A pair of ejection rollers 20 for ejecting the sheet outside of the image forming apparatus is provided above the fixing device 19. Sheets ejected by the pair of ejection rollers 20 are stacked on an ejection tray 21 formed by depressing inward, in a concave manner, an upper surface of the image forming apparatus body.

A waste toner container 22 for holding waste toner is provided between the transfer belt device 8 and the sheet feed cassette 16. A waste toner transport hose not shown in FIG. 1 extending from the belt cleaning device 14 is connected to the entry section of the waste toner container 22.

Figure 2:
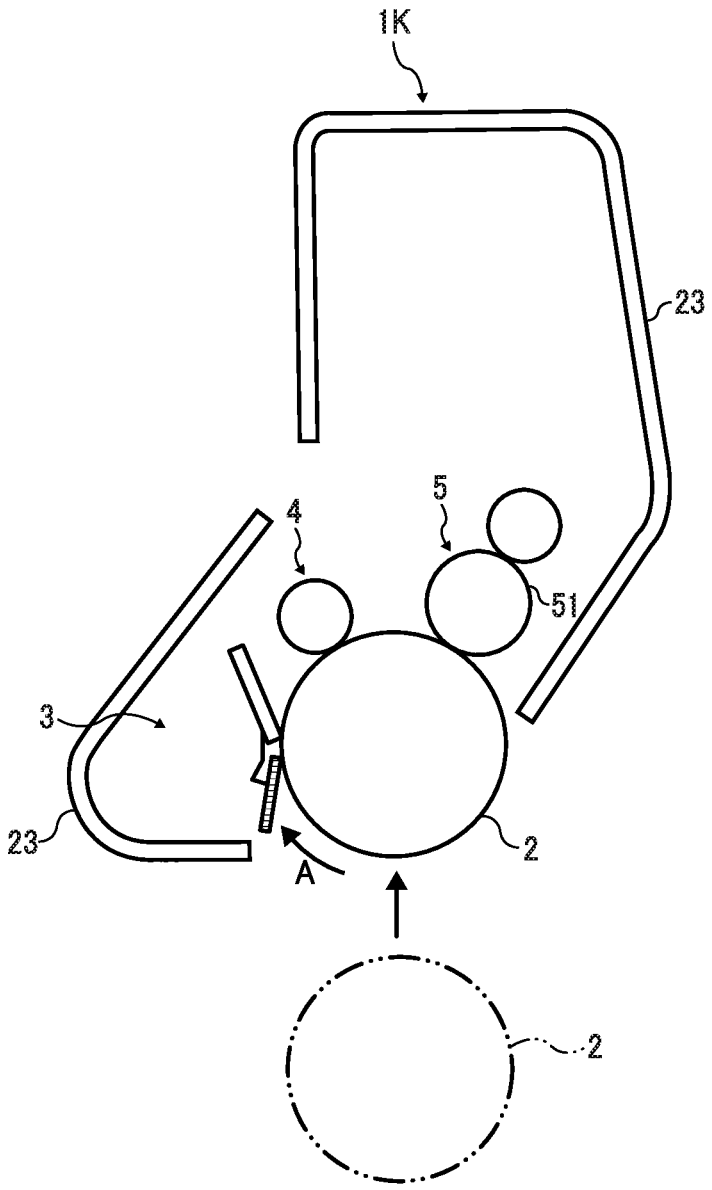
FIG. 2 is a schematic view of a configuration of a process unit detached from an image forming apparatus body or a state of the process unit prior to attachment to the image forming apparatus body.

FIG. 2 is a schematic view of a configuration of the process unit 1K detached from the image forming apparatus body or a state of the process unit 1K prior to attachment to the image forming apparatus body. As shown in FIG. 2, the process unit 1K includes a housing 23. The housing 23 is formed by injection molding a resin. Specific examples of the resin include, but are not limited to, polycarbonate resin, acrylnitrile-butadiene-styrene resin, acrylnitrile-styrene resin, styrene resin, polyphenylene ether resin, polyphenylene oxide resin, polyether terephthalate resin, and an alloy resin of two or more of the above-described resins. The above-described image carrier 2, the cleaning mechanism 3, the charging mechanism 4, and the developing mechanism 5 are provided in the housing 23.

Next is a description of an image forming action in the printer.

When a signal to execute printing from an operation unit not shown in FIG. 1 and FIG. 2 is received, the charging mechanism 4 and a developing roller 51 are applied with respective predetermined voltages or currents at a predetermined timing sequentially. Likewise, an exposure device and a neutralizing lamp are applied with respective predetermined voltages or currents at a predetermined timing sequentially. In addition, in synchronization with the above-described action, a photoreceptor driving motor not shown in FIG. 1 and FIG. 2 serving as a driving mechanism rotationally drives the photoreceptor 2 in the direction of arrow A indicated in FIG. 2.

When the photoreceptor 2 rotates in the direction of arrow A indicated in FIG. 2, first, a surface of the photoreceptor 2 is charged by the charging mechanism 4 to a predetermined potential. Then, a light L corresponding to an image signal from the exposure device not shown in FIG. 2 irradiates the surface of the photoreceptor 2, and portions on the surface of the photoreceptor 2 irradiated with the light L are neutralized and an electrostatic latent image is formed.

The electrostatic latent image formed on the surface of the photoreceptor 2 is rubbed with a magnetic brush of a developer formed on the developing roller 51 by an opposing member in the developing mechanism 5. A negatively charged toner on the developing roller 51 moves to the electrostatic latent image side by a predetermined developing bias applied to the developing roller 51, and the electrostatic latent image is developed into a toner image. As described in the above-described embodiment of the present invention, the electrostatic latent image formed on the surface of the photoreceptor 2 is developed in a reversal development with the negatively charged toner by the developing mechanism 5. In the above-described embodiment of the present invention, an example employing a non-contact charging roller method of negative/positive (hereinafter referred to as N/P) in which a toner adheres to portions having low potential is described. However, the present invention is not limited to the exemplary embodiments described above.

The toner image formed on the surface of the photoreceptor 2 is transferred to a transfer region formed between the primary transfer roller 9*a* and the photoreceptor 2, and then transferred to a transfer sheet fed from a sheet feeder not shown in FIG. 1 and FIG. 2 via an opposing upper registration roller and a lower registration roller. When the transfer sheet is fed, the transfer sheet is fed from the opposing upper registration roller and the lower registration roller in synchronization with an image tip. A predetermined transfer bias is applied when transferring the toner image to the transfer sheet. The transfer sheet having the transferred toner image is separated from the photoreceptor 2 and conveyed to a fixing device not shown in FIG. 1 and FIG. 2 serving as a fixing mechanism. The toner image on the transfer sheet is fixed on the transfer sheet by an effect of heat and pressure by passing through the fixing device, and the transfer sheet is ejected from the image forming apparatus.

Then, a residue toner after transfer is removed from the surface of the photoreceptor 2 after transfer with the cleaning mechanism 3 and the surface of the photoreceptor 2 is neutralized with the neutralizing lamp.

The photoreceptor 2 and process mechanisms of the cleaning mechanism 3, the charging mechanism 4, and the developing mechanism 5 are housed in the housing 23 in the printer according to an embodiment of the present invention. The photoreceptor 2, the cleaning mechanism 3, the charging mechanism 4, and the developing mechanism 5 housed in the housing 23 are detachably attached as a whole to the image forming apparatus body as a process cartridge. It is to be noted that in the above-described embodiment of the present invention, the photoreceptor 2 and process mechanisms serving as the process cartridge are exchanged as a whole. However, a configuration of exchanging the photoreceptor 2, the cleaning mechanism 3, the charging mechanism 4, and the developing mechanism 5, respectively as a unit is also possible.

Next is a description of a cleaning blade according to an embodiment of the present invention.

Figure 3:
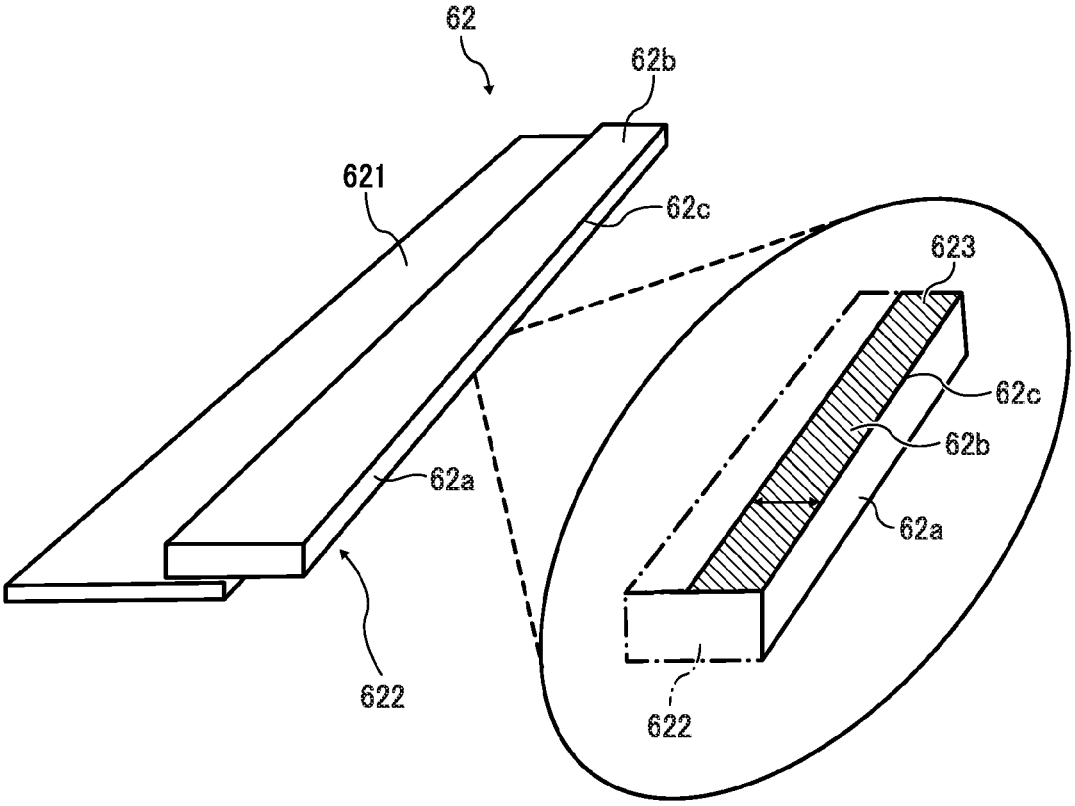
FIG. 3 is a perspective view of a cleaning blade.
Figure 4:
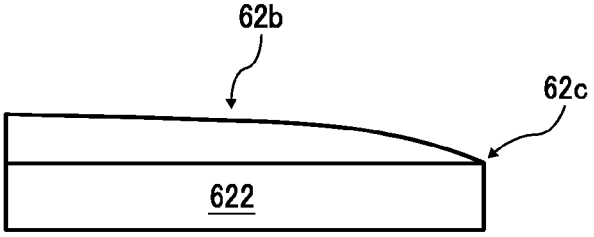
FIG. 4 is an enlarged cross-sectional view of the cleaning blade.

FIG. 3 is a perspective view of the cleaning blade 62. FIG. 4 is an enlarged cross-sectional view of the cleaning blade 62.

The cleaning blade 62 is configured of a holder 621 having a strip shape formed from a rigid material such as a metal or a hard plastic, and a strip shaped elastic blade 622.

The strip shaped elastic blade 622 is fixed with adhesive to one end side of the holder 621. The other end side of the holder 621 is supported in a cantilever manner by a case of the cleaning mechanism 3.

The strip shaped elastic blade 622 preferably has a high restitution elastic modulus so the strip shaped elastic blade 622 can follow eccentricity of the photoreceptor 2 and minute swells of the surface of the photoreceptor 2. The strip shaped elastic blade 622 is preferably formed of a rubber including an urethane group such as urethane rubber.

The strip shaped elastic blade 622 may be a two layer configuration type in which two different materials are laminated.

In the cleaning blade according to an embodiment of the present invention, Martens hardness described in ISO14577-1 is employed as an index of hardness of a surface layer 623. A Martens hardness of the surface layer 623 by itself is determined as in a range from 50 $N/mm^2$ or more to 500 $N/mm^2$ or less. When the Martens hardness is smaller than 50 $N/mm^2$, curling of a leading-edge ridge line portion occurs. When the Martens hardness is larger than 500 $N/mm^2$, cracks in the surface layer 623 may be generated due to friction force between the photoreceptor 2 and the surface layer 623.

The surface layer 623 is formed by spray coating towards a leading-edge ridge line portion 62*c* from a direction of an opposing surface 62*b* of the cleaning blade 62 opposite the surface of the photoreceptor 2. A material employed as the surface layer 623 is preferably a resin, more preferably a thermosetting resin or a photosetting resin such as an ultraviolet ray hardening resin. By employing the thermosetting resin or the photosetting resin, the surface layer 623 having a desired hardness may be obtained by only heating or by irradiating a light such as an ultraviolet ray on the photosetting resin adhering to the leading-edge ridge line portion 62*c* of the cleaning blade 62. Accordingly, the cleaning blade 62 may be manufactured at a low cost.

In a case of employing the ultraviolet ray hardening resin as the above-described photosetting resin, preferably, an acrylate material having a main skeleton of pentaerythritol triacrylate or dipentaerythritol hexaacrylate with a functional group number of 3 to 6 and at least a functional group equivalent weight molecular weight of 350 or less is employed. When a material having a skeleton other than pentaerythritol triacrylate or dipentaerythritol hexaacrylate or having a functional group equivalent weight molecular weight exceeding 350 is employed, the surface layer 623 may become too weak and cleanability over a long time period may not be maintained.

A solvent employed for the above-described resin is preferably a low boiling point solvent having a boiling point of 75° C. or less, more preferably 66° C. or less. In a case of employing the low boiling point solvent, after a coating liquid formed of the resin and the low boiling point solvent is sprayed on and adheres to the leading-edge ridge line portion 62*c* of the cleaning blade 62, the low boiling point solvent quickly volatilizes and the resin remains on the leading-edge ridge line portion 62*c*. By contrast, in a case of employing a high boiling point solvent, the high boiling point solvent of a coating liquid does not volatilize after adhering to the leading-edge ridge line portion 62*c* and the coating liquid wetly spreads to the opposing surface 62*b* opposite the surface of the image carrier 2 from the leading-edge ridge line portion 62*c*. Accordingly, a film thickness at a vicinity of the leading-edge ridge line portion 62*c* cannot be maintained.

If a thick layer of the surface layer 623 is provided up to the leading-edge ridge line portion 62*c*, rigidity becomes too high. As a result, in a case in which the photoreceptor 2 decenters or there are minute swells on the surface of the photoreceptor 2, a contact pressure in a longitudinal direction of the cleaning blade 62 contacting the surface of the photoreceptor 2 fluctuates and following of the leading-edge ridge line portion 62*c* of the cleaning blade 62 with respect to the surface of the photoreceptor 2 declines. Thus, by forming the surface layer 623 up to the leading-edge ridge line portion 62*c* and making a thickness that becomes thicker as a distance from the leading-edge ridge line portion 62*c* increases, decline of following of the leading-edge ridge line portion 62*c* of the cleaning blade 62 with respect to the surface of the photoreceptor 2 may be suppressed and curling of the leading-edge ridge line portion 62*c* may be suppressed. A layer thickness of the surface layer 623 is preferably in a range from 0.2 μm or more to 3 μm or less at a point 20 μm away from the leading-edge ridge line portion 62*c* of the cleaning blade 62. When the layer thickness is 0.2 μm or less, the rigidity of the surface layer 623 becomes low and curling of the leading-edge ridge line portion 62*c* is generated. When the layer thickness is 3 μm or more, the rigidity of the surface layer 623 becomes too high and following with respect to the surface of the photoreceptor 2 declines.

The leading-edge ridge line portion 62*c* of the strip shaped elastic blade 622 may be subjected to impregnation. Impregnation to the leading-edge ridge line portion 62*c* of the strip shaped elastic blade 622 is possible by spray coating or dip coating and impregnating, for example, an ultraviolet ray hardening resin including a fluorine based acrylic monomer. Accordingly, deformation of the leading-edge ridge line portion 62*c* of the strip shaped elastic blade 622 contacting the surface of the photoreceptor 2 in the direction of movement of the surface of the photoreceptor 2 may be suppressed. Further, even when an inner portion of the strip shaped elastic blade 622 is exposed due to wear of the surface layer 623 over time, deformation (i.e., curling or stick-slip movement) of the strip shaped elastic blade 622 is also suppressed due to an effect of impregnation into the inner portion.

Next is a description of conditions of contact of the cleaning blade 62 to the surface of the photoreceptor 2. In the cleaning blade 62 according to an embodiment of the present invention, an initial contact width between the surface layer 623 of the strip shaped elastic blade 622 of the cleaning blade 62 and the surface of the photoreceptor 2 is preferably 12 μm or more to 30 μm or less. When the initial contact width is 12 μm or less, a crushed state of the strip shaped elastic blade 622 is insufficient and contact of the strip shaped elastic blade 622 to the surface of the photoreceptor 2 becomes non-uniform due to a degree of straightness of the cleaning blade 62 in a longitudinal direction and variation of rotational rolling of the photoreceptor 2, and partial cleaning failure may be generated. When the initial contact width is 30 μm or more, the contact pressure disperses and a peak pressure becomes small. Accordingly, the residue toner slips through and cleaning failure is generated. Linear pressure is preferably in a range from 7 N/m or more to 25 N/m or less. When the linear pressure is less than 7 N/m, the peak pressure becomes small and cleaning failure is generated. When the linear pressure exceeds 25 μm, the peak pressure becomes too high and the leading-edge ridge line portion 62*c* is chipped.

Next is a description of an example of a variation of the cleaning blade 62.

Figure 5:
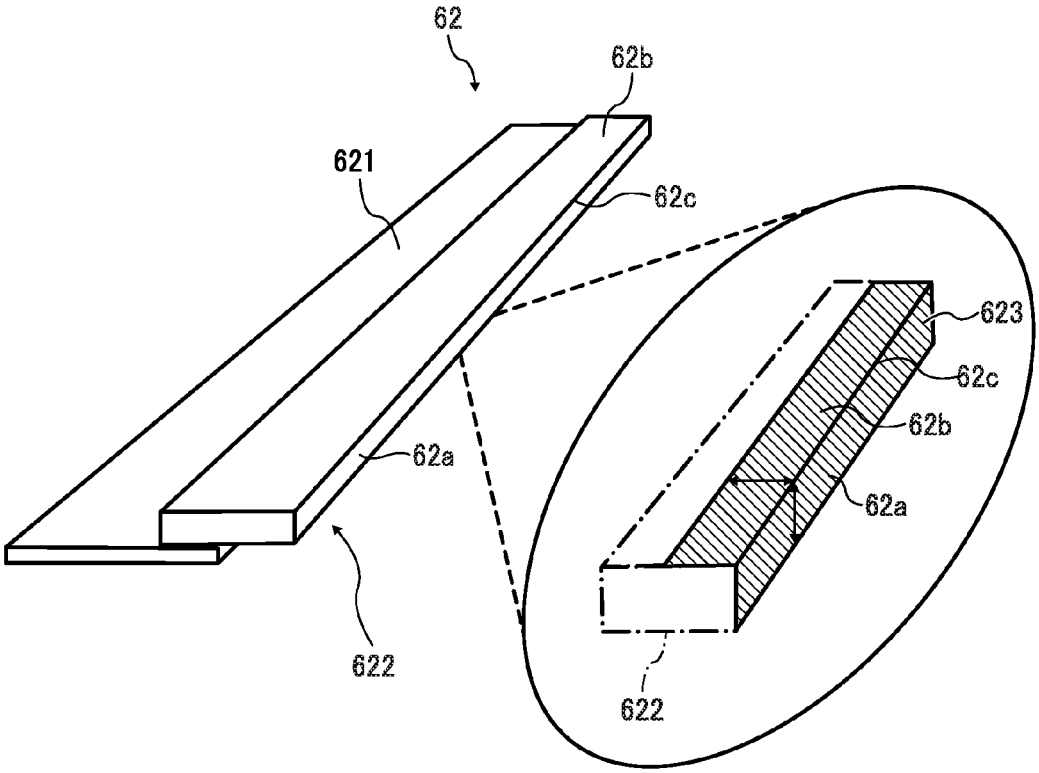
FIG. 5 is a perspective view of an example of a variation of the cleaning blade.
Figure 6:
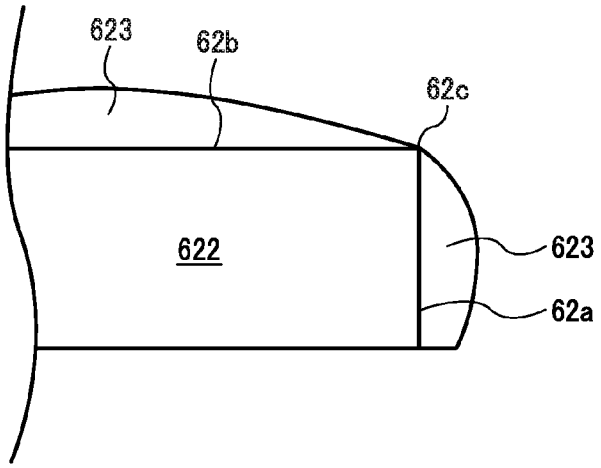
FIG. 6 is an enlarged cross-sectional view of the example of the variation of the cleaning blade.
Figure 7A:
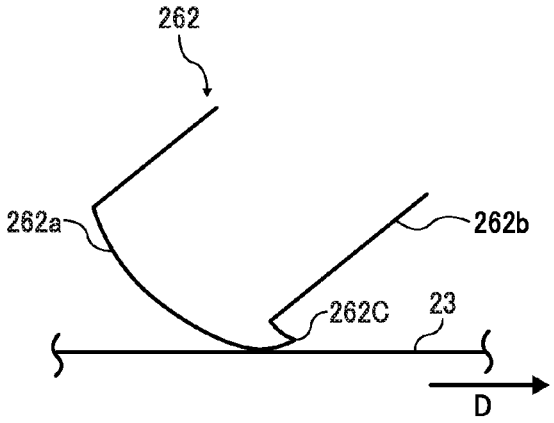
FIG. 7A RELATED ART
FIG. 7A is a schematic view of a state of curling of a leading-edge ridge line portion of a conventional cleaning blade.
Figure 7B:
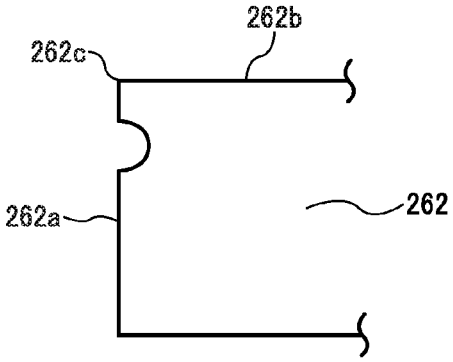
FIG. 7B RELATED ART
FIG. 7B is a schematic view of local wear of the leading-edge ridge line portion of the conventional cleaning blade.
Figure 7C:
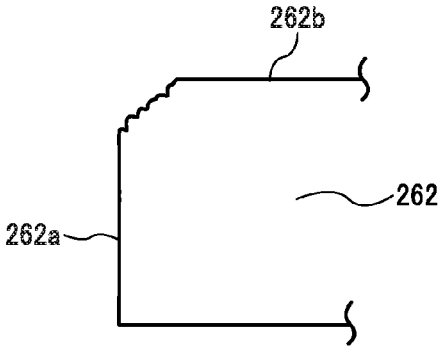
FIG. 7C RELATED ART
FIG. 7C is a schematic view of a state in which the leading-edge ridge line portion of the conventional cleaning blade is lost.

FIG. 5 is a perspective view of the example of the variation of the cleaning blade 62. FIG. 6 is an enlarged cross-sectional view of the example of the variation of the cleaning blade 62.

As shown in FIG. 5 and FIG. 6, the example of the variation of the cleaning blade 62 includes the surface layer 623 formed on the opposing surface 62*b* and on a leading-edge surface 62*a*. The example of the variation of the cleaning blade 62 has the same configuration as the above-described cleaning blade 62 in FIG. 3 and FIG. 4 except for conditions of contact to the surface of the photoreceptor 2.

In the example of the variation of the cleaning blade 62, a condition of contact of the variation of the cleaning blade 62 to the surface of the photoreceptor 2 is an initial contact width preferably in a range from 1 μm or more to 30 μm or less. When the initial contact width is 30 μm or more, a contact pressure disperses and a peak pressure becomes small. Accordingly, a residue toner slips through and cleaning failure is generated.

The following is a verification experiment conducted with an image forming apparatus described in JP-2009-300754-A under an environment of a low temperature of 10° C. and a low humidity of 15% relative humidity (RH).

A cleaning blade employed for the above-described verification experiment is as follows.

[Elastic Blade]

Hardness 71 degrees, Restitution elastic modulus 18% (from Toyo Tire & Rubber Co., Ltd.)

[Surface Layer Material]

Urethane acrylate oligomer: UN-901T (from Negami Chemical Industrial Co., Ltd.) 20 parts Polymerization initiator: Irgacure 184 (from Ciba Specialty Chemicals Inc.) 1 part Low friction coefficient additive: fluorine compound Defensa Exp. TF-3026 (from DIC Corporation) 0.5 parts Solvent: 2-butanone 78.5 parts A surface layer is formed by coating the above-described surface layer material to the above-described elastic blade with a spray coating method. Physical properties of the cleaning blade having the formed surface layer is as follows.

Initial layer thickness at 100 μm from an leading-edge ridge line portion: 5 μm

Initial layer thickness at 20 μm from the leading-edge ridge line portion: 0.1 μm Initial contact width: 30 μm Surface layer hardness: 500 N/mm$^2$ The above-described cleaning blade is attached to the image forming apparatus including a lubricant coating device, and a sheet run test under the environment of the low temperature and the low humidity is conducted. Results show early generation of cleaning failure compared to a verification test under an environment of normal temperature and normal humidity. Significant increase of a wear amount of a leading-edge ridge line portion and increase of a contact width between the elastic blade and a surface of an image carrier compared to the verification test under the environment of normal temperature and normal humidity is observed upon observation of the cleaning blade after the verification test. When the contact width between the elastic blade and the surface of the image carrier increases, a contact pressure between the elastic blade and the surface of the image carrier disperses within a scope of contact between the elastic blade and the surface of the image carrier. Accordingly, a peak value of the contact pressure becomes small. As a result, cleaning failure is believed to be generated.

A reason regarding accelerated wear of the leading-edge ridge line portion under the environment of the low temperature and the low humidity environment is unclear. The following is regarded to be the reason. The image forming apparatus of JP-2009-300754-A employed in the verification experiment includes the lubricant coating device that continuously coats the surface of the image carrier with a lubricant for protection of the surface of the image carrier. The lubricant supplied to the surface of the image carrier enhances lubricity under the environment of normal temperature and normal humidity. However, under the environment of the low temperature and the low humidity environment, a change is believed to have occurred to the lubricant and the lubricant could not function as originally intended. In a configuration of coating the lubricant on the surface of the image carrier as in the image forming apparatus of JP-2009-300754-A, a problem of dependence on environment for obtaining good cleanability over time is generated.

To overcome the above-described problem, a configuration of an image forming apparatus without the lubricant coating device that coats the surface of the image carrier with the lubricant is possible. The following results is obtained when a verification experiment with the image forming apparatus without the lubricant coating device that coats the surface of the image carrier with the lubricant is conducted. Wear of the leading-edge ridge line portion of the elastic blade is suppressed under environments of low temperature and low humidity; normal temperature and normal humidity; and high temperature and high humidity. However, friction force between the elastic blade and the surface of the image carrier increases due to removing the lubricant. Accordingly, in the cleaning blade configured as described in JP-2009-300754-A, curling of the leading-edge ridge line portion of the elastic blade occurs and cleaning failure is generated. Further, in a case of no lubricant and an initial contact width between the elastic blade and the surface of the image carrier determined as 30 μm or more to 80 μm or less, a peak value of the contact pressure is insufficient and cleaning performance declines.

Accordingly, the following verification experiment is conducted. Conditions in which good cleanability over time with no lubricant are determined.

[Verification Experiment 1]

The following is a description of the verification experiment 1.

[Elastic Blade]

An elastic blade formed of urethane rubber (from Toyo Tire & Rubber Co., Ltd.) having a Martens hardness of 0.8 N/mm$^2$ at 25° C. is prepared.

Measurement of Martens hardness is conducted by employing a microhardness measurement instrument Fischerscope HM2000 (from Fischer Instrumentation Ltd.) and a Vickers indenter at a pressing force of 1 mN and a pressing time of 10 seconds.

[Impregnation and Surface Layer Material]

Hardening materials employed for impregnation and forming the surface layer 623 are surface layer materials 1 to 7 as follows.

<Surface Layer Material 1>

Ultraviolet ray hardening resin: DPHA (from Daicel Cytec Ltd.) 20 parts

Polymerization initiator: Irgacure 184 (from Ciba Specialty Chemicals Inc.) 1 part Solvent: tetrahydrofuran 78 parts, boiling point 66° C.

Coating film hardness: 463 N/mm$^2$ (Martens hardness)

<Surface Layer Material 2>

Ultraviolet ray hardening resin (Primary material): PETIA (from Daicel Cytec Ltd.) 11.4 parts Ultraviolet ray hardening resin (Secondary material): ODA-N (from Daicel Cytec Ltd.) 8.6 parts Polymerization initiator: Irgacure 184 (from Ciba Specialty Chemicals Inc.) 2 parts Solvent: tetrahydrofuran 78 parts, boiling point 66° C.

Coating film hardness: 92 N/mm$^2$ (Martens hardness)

<Surface Layer Material 3>

Ultraviolet ray hardening resin: DPHA (from Daicel Cytec Ltd.) 20 parts

Polymerization initiator: Irgacure 184 (from Ciba Specialty Chemicals Inc.) 2 parts Solvent: cyclohexanone 78 parts, boiling point 156° C.

Coating film hardness: 463 N/mm$^2$ (Martens hardness)

<Surface Layer Material 4>

Ultraviolet ray hardening resin (Primary material): PETIA (from Daicel Cytec Ltd.) 11.4 parts Ultraviolet ray hardening resin (Secondary material): ODA-N (from Daicel Cytec Ltd.) 8.6 parts Polymerization initiator: Irgacure 184 (from Ciba Specialty Chemicals Inc.) 2 parts Solvent: cyclohexanone 78 parts, boiling point 156° C.

Coating film hardness: 92 N/mm$^2$ (Martens hardness)

<Surface Layer Material 5>

Ultraviolet ray hardening resin: PETIA (from Daicel Cytec Ltd.) 20 parts

Polymerization initiator: Irgacure 184 (from Ciba Specialty Chemicals Inc.) 2 parts Solvent: cyclohexanone 78 parts, boiling point 156° C.

Coating film hardness: 388 N/mm$^2$ (Martens hardness)

<Surface Layer Material 6>

Ultraviolet ray hardening resin: Kayarad DPCA-120 (from Nippon Kayaku Co., Ltd.) 20 parts Polymerization initiator: Irgacure 184 (from Ciba Specialty Chemicals Inc.) 2 parts Solvent: tetrahydrofuran 78 parts, boiling point 66° C.

Coating film hardness: 26 N/mm$^2$ (Martens hardness)

<Surface Layer Material 7>

Ultraviolet ray hardening resin: Kayarad DPCA-120 (from Nippon Kayaku Co., Ltd.) 20 parts Polymerization initiator: Irgacure 184 (from Ciba Specialty Chemicals Inc.) 2 parts Solvent: cyclohexanone 78 parts, boiling point 156° C.

Coating film hardness: 26 N/mm$^2$ (Martens hardness)

Structural formula of dipentaerythritol hexaacrylate (DPHA) employed as the ultraviolet ray hardening resin of the surface layer material 1 is shown in chemical 1.

[Chemical 1]

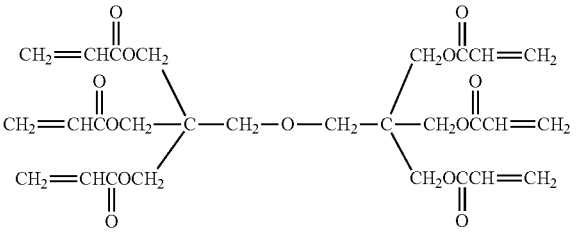

Structural formula of pentaerythritol triacrylate (PETIA) employed as the ultraviolet ray hardening resin of the surface layer material 2 and the surface layer material 5 is shown in chemical 2.

[Chemical 2]

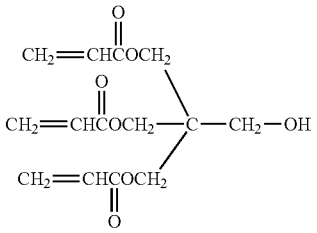

Structural formula of dipentaerythritol hexaacrylate (Kayarad DPCA-120) employed as the ultraviolet ray hardening resin of the surface layer material 6 and the surface layer material 7 is shown in chemical 3.

[Chemical 3]

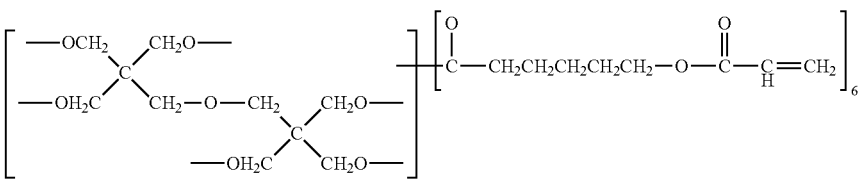

In verification experiment 1, PETIA, DPHA, and DPCA-120 that are acrylate materials having a main skeleton of pentaerythritol triacrylate or dipentaerythritol hexaacrylate with a functional group number of 3 to 6 and a functional group equivalent weight molecular weight of 350 or less are employed.

The following is a description of a configuration of an image forming apparatus employed in the verification experiment 1.

An elastic blade having a strip shape with a thickness of 1.8 mm is formed employing the above-described urethane rubber for examples 1 to 4 and comparative examples 1 to 6, respectively. A surface layer of each of the surface layer materials constituting hardening resin materials is formed on each of the elastic blades with a spray coating method. More specifically, each surface layer is formed by spray coating each of the surface layer materials on an opposing surface, provided opposite a surface of an image carrier, of each of the elastic blades to a predetermined layer thickness at a spray gun moving speed of 10 mm/s. After spray coating, each of the surface layers is dried for three minutes until each of the surface layers is dry to touch. Then, ultraviolet ray exposure of 140 W/cm×5 m/min×3 passes is conducted. After conducting ultraviolet ray exposure, heat drying with an oven at 100° C. for fifteen minutes is conducted. Layer thickness of each of the surface layers is formed to become thicker as a distance from the leading-edge ridge line portion increases.

The layer thickness is measured by employing a microscope VHX-100 (from Keyence Corporation) and measuring a cross-section surface of separate elastic blades coated in the same manner as described above. Samples of the cross-section surface of the separate elastic blades for measurement are cut employing a trimming razor for manufacturing a sample for a scanning electron microscope (SEM) (from Nisshin EM Corporation).

Each of the elastic blades having the formed surface layers is fixed with adhesive to a sheet metal holder that may be attached to a color multifunctional system imagio MP C5001 (from Ricoh Company, Ltd.) having the same configuration as the image forming apparatus of FIG. 1, and respective sample cleaning blades are formed. Each of the sample cleaning blades is attached to the color multifunctional system imagio MP C5001 (from Ricoh Company, Ltd.). An initial contact width (i.e., initial contact width of a leading-edge ridge line portion of a cleaning blade with respect to a surface of a photoreceptor) between the surface of the photoreceptor and each of the sample cleaning blades is made different from each other. Accordingly, examples 1 to 4 and comparative examples 1 to 6 of the image forming apparatus are prepared. Linear pressure of each of the sample cleaning blades is set to 7 N/mm. The initial contact width is adjusted by determining a cleaning angle serving as a desired initial contact width while observing a contact state between each of the sample cleaning blades and the photoreceptor from a side with a separate jig that can confirm the contact state. A blade attachment bracket is processed to enable attachment of each of the sample cleaning blades at the determined angle to the color multifunctional system imagio MP C5001 (from Ricoh Company, Ltd.). A lubricant coating device is removed.

A toner formed with a polymerization method is employed in the verification experiment 1. Physical properties of the toner is as follows.

Toner Base:

Circularity 0.98, Average particle diameter 4.9 μm

External Additives:

Small particle diameter silica (H2000, from Clariant Japan) 1.5 parts

Small particle diameter titanium oxide (MT-150AI, from Tayca Corporation) 0.5 parts Large particle diameter silica (UFP-30H, from Denki Kagaku Kogyo Kabushiki Kaisha) 1.0 part The verification experiment 1 is conducted under an experiment room environment of 21° C. and 65% RH, and sheet feed conditions of 3 prints/job of a 5% image area chart. 2500 sheets (A4 size sheet horizontal) are fed and evaluation with respect to the following items are conducted.

[Evaluation Items]

Generation of cleaning failure: Yes or No (Visual observation of 5% image area chart output) Curling of leading-edge ridge line portion: Yes or No (A sheet shaped photoreceptor is pasted to a transparent glass cylinder, and observed from below)

Local Wear: Yes or No (Observation of leading-edge ridge line portion with a microscope VHX-100 from Keyence Corporation)

Results of the verification experiment 1 are shown in Table 1.

TABLE 1

| | Surface layer material | Initial contact width (μm) | Layer thickness of surface layer at point of 20 μm (μm) | Martens hardness (N/mm$^2$) | Cleaning failure | Curling of leading-edge ridge line portion | Local wear |
|---|---|---|---|---|---|---|---|
| Example 1 | 1 | 12 | 0.7 | 463 | No | No | No |
| Example 2 | 1 | 15 | 0.2 | 463 | No | No | No |
| Example 3 | 2 | 16 | 2.5 | 92 | No | No | No |
| Example 4 | 2 | 30 | 1.6 | 92 | No | No | No |
| Comparative example 1 | None | 20 | — | — | Yes | Yes, Significant curling | Yes, Significant wear |
| Comparative example 2 | 3 | 19 | 0 | 463 | Yes | Yes | Yes |
| Comparative example 3 | 4 | 19 | 0 | 92 | Yes | Yes | Yes |
| Comparative example 4 | 5 | 20 | 0 | 388 | Yes | Yes | Yes |
| Comparative example 5 | 6 | 33 | 0.2 | 26 | Yes | Yes, Slight curling | Yes, Slight wear |
| Comparative example 6 | 7 | 10 | 0.1 | 26 | Yes | Yes | Yes |

In comparative examples 2 to 4, each of the surface layers is formed with the solvent having the boiling point of 156° C. and have a surface layer film thickness of 0 μm at a point of 20 μm from the leading-edge ridge line portion, respectively. Thus, each of the surface layers of comparative examples 2 to 4 is not formed up to the leading-edge ridge line portion of each of the elastic blades of comparative examples 2 to 4. Further, the surface layer of comparative example 6 is also formed with the solvent having the boiling point of 156° C. and has a surface layer film thickness of 0.1 μm at a point of 20 μm from the leading-edge ridge line portion of the elastic blade of comparative example 6. As described above, each of the surface layers of comparative examples 2 to 4 and comparative example 6 formed with the solvent having the boiling point of 156° C. do not have sufficient thickness at the vicinity of the leading-edge ridge line portion of each of the elastic blades of comparative examples 2 to 4 and comparative example 6. Accordingly, rigidity at the vicinity of the leading-edge ridge line portion of each of the elastic blades of comparative examples 2 to 4 and comparative example 6 is not sufficiently enhanced with each of the formed surface layers. As a result, under a condition of no lubricant in which friction force between the surface of the photoreceptor and each of the sample cleaning blades of comparative examples 2 to 4 and comparative example 6 is large, curling of leading-edge ridge line portions and local wear are generated and cleaning failure is generated.

On the other hand, in examples 1 to 4 in which each of the surface layers are formed with the solvent having the boiling point of 66° C., each of the surface layers is formed up to the leading-edge ridge line portion of each of the elastic blades of examples 1 to 4. Accordingly, rigidity at the vicinity of the leading-edge ridge line portion of each of the elastic blades of examples 1 to 4 is sufficiently enhanced by each of the formed surface layers. Accordingly, good cleanability over time is obtained with no generation of curling of leading-edge ridge line portions and local wear under a condition of no lubricant.

A configuration in which the surface layer has sufficient thickness at the vicinity of the leading-edge ridge line portion and no occurrence of curling of the leading-edge ridge line portion is obtained even with high friction force between the surface of the photoreceptor and the leading-edge ridge line portion at an initial contact width of 30 μm or less. In addition, the initial contact width may be made small, and a peak pressure may be made high without dispersing a contact pressure. Accordingly, good cleanability is obtained.

In comparative example 5 having an initial contact width of 30 μm or more, cleaning failure is generated. Slipping through of a residue toner and generation of cleaning failure are considered to be due to dispersion of a contact pressure resulting in a decline of a peak pressure. Further, in comparative example 5, slight curling of a leading-edge ridge line portion and local wear are exhibited. The generation of curling of the leading-edge ridge line portion and local wear are considered to be due to a hardness of the surface layer of comparative example 5 being smaller than 50 N/mm$^2$.

The examples 1 to 4 have an initial contact width in a range from 12 μm to 30 μm, a surface layer film thickness in a range from 0.2 μm to 3 μm at a point of 20 μm from the leading-edge ridge line portion of each of the elastic blades of the examples 1 to 4, and a Martens hardness of the surface layer of each of the examples 1 to 4 is in a range from 50 to 500 N/mm. Good cleanability over time with no generation of curling of the leading-edge ridge line portions and local wear is obtained with the examples 1 to 4.

[Verification Experiment 2]

The following is a description of a verification experiment 2.

The verification experiment 2 examines a cleaning blade of the variation of the cleaning blade 62 shown in FIG. 5 and FIG. 6 including the surface layer 623 formed on the leading-edge surface 62*a* and the opposing surface 62*b* of the strip shaped elastic blade 622.

An elastic blade having a strip shape with a thickness of 1.8 mm is formed employing the same urethane rubber used in the verification experiment 1 for examples 1 to 9 and comparative examples 1 to 4, respectively. A surface layer of the following surface layer materials constituting hardening resin materials is formed on each of the elastic blades with a spray coating method. The surface layer materials 1 to 4 and 6 of the verification experiment 1 are employed as the hardening resin materials. More specifically, each surface layer is formed by spray coating each of the surface layer materials on an opposing surface and a leading-edge surface of each of the elastic blades to a predetermined layer thickness at a spray gun moving speed of 10 mm/s. The opposing surface is provided opposite a surface of an image carrier. The leading-edge surface is provided perpendicular to the opposing surface and sandwiches a leading-edge ridge line portion with the opposing surface. After spray coating, each of the surface layers is dried for three minutes until each of the surface layers is dry to touch. Then, ultraviolet ray exposure of 140 W/cm×5 m/min×3 passes is conducted. After conducting ultraviolet ray exposure, heat drying with an oven at 100° C. for fifteen minutes is conducted.

Configuration of an image forming apparatus, toner, and evaluation items of the verification experiment 2 is the same as verification experiment 1.

Results of the verification experiment 2 are shown in Table 2.

TABLE 2

| | Surface layer material | Tilt with leading-edge ridge line portion as point of origin: Yes or No | Initial contact width (μm) | Opposing surface/ Leading-edge surface: layer thickness of surface layer at point of 20 μm | Martens hardness (N/mm$^2$) | Cleaning failure | Curling of leading-edge ridge line portion | Local wear | Notes |
|---|---|---|---|---|---|---|---|---|---|
| Example 1 | 1 | Yes | 1 | 0.7 | 463 | No | No | No | |
| Example 2 | 2 | Yes | 1 | 0.7 | 92 | No | No | No | |
| Example 3 | 1 | Yes | 10 | 0.7 | 463 | No | No | No | |
| Example 4 | 1 | Yes | 30 | 0.7 | 463 | No | No | No | |
| Example 5 | 2 | Yes | 1 | 3 | 92 | No | No | No | |
| Example 6 | 1 | Yes | 1 | 0.2 | 463 | No | No | No | |
| Example 7 | 2 | Yes | 1 | 0.1 | 92 | No | Yes, Slight curling | No | |

TABLE 2-continued

| | Surface layer material | Tilt with leading-edge ridge line portion as point of origin: Yes or No | Initial contact width (μm) | Opposing surface/ Leading-edge surface: layer thickness of surface layer at point of 20 μm | Martens hardness ($N/mm^2$) | Cleaning failure | Curling of leading-edge ridge line portion | Local wear | Notes |
|---|---|---|---|---|---|---|---|---|---|
| Example 8 | 2 | Yes | 1 | 4 | 92 | No | No | No | Crack generated in part of surface layer |
| Example 9 | 6 | Yes | 1 | 3 | 26 | No | Yes, Slight curling | No | |
| Comparative Example 1 | None | — | 20 | — | — | Yes | Yes, Significant curling | Yes, Significant wear | |
| Comparative Example 2 | 3 | No | 19 | 0 | 463 | Yes | Yes | Yes | |
| Comparative Example 3 | 4 | No | 19 | 0 | 92 | Yes | Yes | Yes | |
| Comparative Example 4 | 2 | Yes | 50 | 0.7 | 92 | Yes, Slight cleaning failure | No | Yes | |

As shown in table 2, in a configuration of the variation of the cleaning blade 62 shown in FIG. 5 and FIG. 6 including the surface layer 623 formed on the leading-edge surface 62*a* and the opposing surface 62*b* of the strip shaped elastic blade 622, curling of the leading-edge ridge line portion and local wear are suppressed in an initial contact width in a range from 1 μm to 30 μm. In example 8 having a surface layer film thickness of 4 μm at a point 20 μm from a leading-edge ridge line portion, a crack is generated in a part of the surface layer. In example 7 having a surface layer film thickness of 0.1 μm, slight curling of the leading-edge ridge line portion is exhibited. On the other hand, no curling of the leading-edge ridge line portions and no cracks are exhibited in the surface layers in examples 1 to 6 having a surface layer film thickness of 0.2 μm to 3 μm. In comparative examples 2 and 3 of the verification experiment 2 in which the surface layers are formed with the solvent having the boiling point of 156° C., the surface layers are formed at a point away from the leading-edge ridge line portion and not formed from the leading-edge ridge line portions of the elastic blades as in examples 1 to 9.

Even in verification experiment 2, surface layers may be formed up to the leading-edge ridge line portions and rigidity at the vicinity of the leading-edge ridge line portions may be sufficiently enhanced. Thus, good cleanability over time with no generation of curling of the leading-edge ridge line portion and local wear under a condition of no lubricant is obtained in the verification experiment 2.

A configuration in which the surface layer has sufficient thickness at the vicinity of the leading-edge ridge line portion and no occurrence of curling of the leading-edge ridge line portion is obtained even with high friction force between the surface of the photoreceptor and the leading-edge ridge line portion at an initial contact width of 30 μm or less. In addition, the initial contact width may be made small, and a peak pressure may be made high without dispersing a contact pressure. Accordingly, good cleanability is obtained.

Further, due to forming the surface layer 623 not only on the opposing surface 62*b* but also on the leading-edge surface 62*a*, rigidity may be enhanced in comparison to forming the surface layer 623 only on the opposing surface 62*b*. Accordingly, good cleanability is obtained with no generation of curling of leading-edge ridge line portion and local wear even with an initial contact width of 1 μm.

In accordance with the present invention, good cleanability over time is obtained as shown by the results of the verification experiments.

The descriptions thus far are examples of an embodiment of the present invention. Each aspect of the present invention exhibit particular effects as follows.

[Aspect 1]

The image forming apparatus including the image carrier 2 such as the photoreceptor 2, the charging mechanism 4 to charge a surface of the image carrier 2, an electrostatic latent image forming mechanism such as the exposure unit 7 to form the electrostatic latent image on the charged surface of the image carrier 2, the developing mechanism 5 to develop the electrostatic latent image formed on the surface of the image carrier 2 into a toner image, the transfer mechanism such as the transfer belt device 8 to transfer the toner image on the surface of the image carrier 2 to a transfer body such as the intermediate transfer belt 12, and the cleaning mechanism 3 including the cleaning blade 62 to clean a transfer residue toner adhering to the surface of the image carrier 2 by contacting the surface of the image carrier 2. The cleaning blade 62 includes the strip shaped elastic blade 622 and the surface layer 623 formed on the opposing surface 62*b* of the strip shaped elastic blade 622 opposite the surface of the image carrier 2. The surface layer 623 having a hardness harder than the strip shaped elastic blade 622 and the layer thickness becoming thicker as the distance from the leading-edge ridge line portion 62*c* increases. The surface layer 623 is formed up to the leading-edge ridge line portion 62*c* of the cleaning blade 62. The leading-edge ridge line portion 62*c* of the cleaning blade 62 contacts the surface of the image carrier 2 with the initial contact width between the cleaning blade 62 and the surface of the image carrier 2 in the range from 12 μm or more to 30 μm or less.

In JP-2009-300754-A, a surface layer is formed by coating a coating liquid of JP-2009-300754-A formed of an ultraviolet ray hardening resin and a solvent of JP-2009-300754-A on an opposing surface of an elastic blade opposite a photoreceptor, volatilizing the solvent of JP-2009-300754-A, and irradiating an ultraviolet ray. The coating liquid of JP-2009-

300754-A adhering to a leading-edge ridge line portion spreads from the leading-edge ridge line portion due to a wet property of the coating liquid of JP-2009-300754-A while the solvent of JP-2009-300754-A volatizes. Accordingly, the surface layer is formed at a point of a few μm away from the leading-edge ridge line portion of the opposing surface. As a result, a thickness of the surface layer at a vicinity of the leading-edge ridge line portion is insufficient, and rigidity at the vicinity of the leading-edge ridge line portion at a moving direction of a surface of the photoreceptor is not sufficiently enhanced. Thus, in JP-2009-300754-A, an initial contact width is determined as 30 μm or more to suppress a contact pressure between the leading-edge ridge line portion and the photoreceptor and suppress friction force between the leading-edge ridge line portion and the photoreceptor, and prevent curling of the leading-edge ridge line portion.

By contrast, the surface layer 623 is formed from the leading-edge ridge line portion 62*c*. More specifically, by employing the low boiling point solvent having the boiling point of 75° C. or less as the solvent of the coating liquid, the solvent of the coating liquid coated on the opposing surface 62*b* of the strip shaped elastic blade 622 quickly volatizes and dries. Accordingly, a time period of a liquid state of the coating liquid coated on the opposing surface 62*b* of the strip shaped elastic blade 622 is small, and spreading of the coating liquid adhering to the leading-edge ridge line portion 62*c* from the leading-edge ridge line portion 62*c* due to a wet property of the coating liquid is prevented. As a result, the surface layer 623 may be formed up to the leading-edge ridge line portion 62*c*. The surface layer 623 is formed up to the leading-edge ridge line portion 62*c* and has sufficient thickness at a vicinity of the leading-edge ridge line portion, and rigidity at the vicinity of the leading-edge ridge line portion 62*c* at a moving direction of the surface of the image carrier 2 is sufficiently enhanced. Accordingly, a configuration in which curling of the leading-edge ridge line portion 62*c* does not occur is obtained even with high contact pressure and high friction force between the surface of the image carrier 2 and the leading-edge ridge line portion 62*c* at an initial contact width of 30 μm or less. Thus, by forming the surface layer 623 up to leading-edge ridge line portion 62*c*, the initial contact width may be made 30 μm or less and good cleanability may be maintained over a time sufficiently long. It is to be noted that curling of the leading-edge ridge line portion 62*c* as shown in the verification experiments is generated if the initial contact width is less than 12 μm.

[Aspect 2]

The image forming apparatus including the image carrier 2 such as the photoreceptor 2, the charging mechanism 4 to charge the surface of the image carrier 2, the electrostatic latent image forming mechanism such as the exposure unit 7 to form the electrostatic latent image on the charged surface of the image carrier 2, the developing mechanism 5 to develop the electorstatic latent image formed on the surface of the image carrier 2 into the toner image, the transfer mechanism such as the transfer belt device 8 to transfer the toner image on the surface of the image carrier 2 to a transfer body such as the intermediate transfer belt 12, and the cleaning mechanism 3 including the cleaning blade 62 to clean a transfer residue toner adhering to the surface of the image carrier 2 by contacting the surface of the image carrier 2. The cleaning blade 62 includes the strip shaped elastic blade 622, and the surface layer 623. The surface layer 623 is formed on the opposing surface 62*b* of the strip shaped elastic blade 622, the opposing surface 62*b* provided opposite the surface of the image carrier 2, and the leading-edge surface 62*a*, the leading-edge surface 62*a* provided perpendicular to the opposing surface 62*b* and sandwiches the leading edge ridge line portion 62*c* with the opposing surface 62*b*. The surface layer 623 having a hardness harder than the strip shaped elastic blade 622 and the layer thickness becoming thicker as the distance from the leading-edge ridge line portion 62*c* increases. The surface layer 623 is formed up to the leading-edge ridge line portion 62*c* of the cleaning blade 62. The leading-edge ridge line portion 62*c* of the cleaning blade 62 contacts the surface of the image carrier 2 with the initial contact width between the cleaning blade 62 and the surface of the image carrier 2 in the range from 1 μm or more to 30 μm or less.

Thus, in aspect 2, the surface layer 623 is also formed up to leading-edge ridge line portion 62*c* and the initial contact width may be made 30 μm or less and good cleanability may be maintained over a time sufficiently long.

[Aspect 3]

The image forming apparatus according to aspect 1 or aspect 2 in which the layer thickness of the surface layer 623 is in the range from 0.2 μm or more to 3 μm or less at a point 20 μm away from the leading-edge ridge line portion 62*c* of the cleaning blade 62.

With a configuration described in aspect 3, decline of following of the leading-edge ridge line portion 62*c* of the cleaning blade 62 with respect to the surface of the image carrier 2 may be suppressed and curling of the leading-edge ridge line portion may be suppressed as described in the above-described embodiment of the present invention.

[Aspect 4]

The image forming apparatus according to any one of aspect 1 to aspect 3 in which the surface layer 623 is formed by coating the strip shaped elastic blade 622 with a coating including the solvent having the boiling point of 75° C. or less.

With a configuration described in aspect 4, the surface layer 623 may be formed up to the leading-edge ridge line portion 62*c* as described in the above-described embodiment of the present invention. Accordingly, sufficient thickness of a coating film at the vicinity of the leading-edge ridge line portion 62*c* is obtained and hardness of the leading-edge ridge line portion 62*c* may be made high. As a result, curling of the leading-edge ridge line portion 62*c* is suppressed even with the configuration of high contact pressure and high friction force between the surface of the image carrier 2 and the leading-edge ridge line portion 62*c* at the initial contact width of 30 μm or less.

[Aspect 5]

The image forming apparatus according to any one of aspect 1 to aspect 4 further including a configuration in which no lubricant is coated on the surface of the image carrier 2.

With the configuration described in aspect 5, as described in the above-described embodiment of the present invention, wear of the leading-edge ridge line portion of the strip shaped elastic blade 622 may be suppressed under environments of low temperature and low humidity; normal temperature and normal humidity; and high temperature and high humidity.

[Aspect 6]

The image forming apparatus according to any one of aspect 1 to aspect 5 in which the Martens hardness of the surface layer 623 is in the range from 50 $N/mm^2$ or more to 500 $N/mm^2$ or less.

With a configuration described in aspect 6, curling of the leading-edge ridge line portion 62*c* is suppressed and occurrence of cracks in the surface layer 623 may be suppressed as described in the above-described embodiment of the present invention.

[Aspect 7]

The image forming apparatus according to any one of aspect 1 to aspect 6 in which the surface layer 623 is the thermosetting resin or the photosetting resin.

With a configuration described in aspect 7, as described in the above-described embodiment of the present invention, the surface layer 623 may be easily formed and the cleaning blade 62 may be manufactured at a low cost.

[Aspect 8]

The image forming apparatus according to aspect 7 in which the surface layer 623 is formed of the acrylate material having the main skeleton of pentaerythritol triacrylate or dipentaerythritol hexaacrylate with the functional group number of 3 to 6 and at least the functional group equivalent weight molecular weight of 350 or less.

With a configuration described in aspect 8, the surface layer 623 having the desired hardness may be obtained as described in the above-described embodiment of the present invention.

[Aspect 9]

The process cartridge including the image carrier 2, and the cleaning mechanism 3 including the cleaning blade 62 to at least clean the transfer residue toner adhering to the surface of the image carrier 2. The process cartridge supports the image carrier 2 and the cleaning mechanism 3 as a single unit, and is detachably attached with respect to a body of the image forming apparatus. The cleaning blade 62 includes the strip shaped elastic blade 622, and the surface layer 623 formed on the opposing surface 62*b* of the strip shaped elastic blade 622 opposite the surface of the image carrier 2. The surface layer 623 having a hardness harder than the strip shaped elastic blade 622 and the layer thickness becoming thicker as the distance from the leading-edge ridge line portion 62*c* increases. The surface layer 623 is formed up to the leading-edge ridge line portion 62*c* of the cleaning blade 62. The leading-edge ridge line portion 62*c* of the cleaning blade 62 contacts the surface of the image carrier 2 with the initial contact width between the cleaning blade 62 and the surface of the image carrier 2 in the range from 12 μm or more to 30 μm or less.

With a configuration described in aspect 9, the process cartridge having good cleanability may be provided.

[Aspect 10]

The process cartridge including the image carrier 2, and the cleaning mechanism 3 including the cleaning blade 62 to at least clean the transfer residue toner adhering to the surface of the image carrier 2. The process cartridge supports the image carrier 2 and the cleaning mechanism 3 as a single unit, and is detachably attached with respect to a body of the image forming apparatus. The cleaning blade 62 includes the strip shaped elastic blade 622, and the surface layer 623. The surface layer 623 is formed on the opposing surface 62*b* of the strip shaped elastic blade 622, the opposing surface 62*b* provided opposite the surface of the image carrier 2, and the leading-edge surface 62*a*, the leading-edge surface 62*a* provided perpendicular to the opposing surface 62*b* and sandwiches the leading edge ridge line portion 62*c* with the opposing surface 62*b*. The surface layer 623 having a hardness harder than the strip shaped elastic blade 622 and the layer thickness becoming thicker as the distance from the leading-edge ridge line portion 62*c* increases. The surface layer 623 is formed up to the leading-edge ridge line portion 62*c* of the cleaning blade 62. The leading-edge ridge line portion 62*c* of the cleaning blade 62 contacts the surface of the image carrier 2 with the initial contact width between the cleaning blade 62 and the surface of the image carrier 2 in the range from 1 μm or more to 30 μm or less.

With a configuration described in aspect 10, the process cartridge having good cleanability may be provided.

What is claimed is:

1. An image forming apparatus, comprising:

an image carrier;

a charging mechanism to charge a surface of the image carrier;

an electrostatic latent image forming mechanism to form an electrostatic latent image on the surface of the image carrier;

a developing mechanism to develop the electrostatic latent image formed on the surface of the image carrier into a toner image;

a transfer mechanism to transfer the toner image on the surface of the image carrier to a transfer body; and a cleaning mechanism including a cleaning blade to clean a transfer residue toner adhering to the surface of the image carrier by contacting the surface of the image carrier, wherein the cleaning blade includes a strip shaped elastic blade and a surface layer formed on an opposing surface of the strip shaped elastic blade opposite the surface of the image carrier, the surface layer having a hardness harder than the strip shaped elastic blade and a layer thickness becoming thicker as a distance from a leading-edge ridge line portion of the strip shaped elastic blade increases, and is formed up to the leading-edge ridge line portion, and wherein the leading-edge ridge line portion of the cleaning blade contacts the surface of the image carrier with an initial contact width between the cleaning blade and the surface of the image carrier in a range from 12 μm or more to 30 μm or less, and includes a linear pressure in a range from 7 N/m to less than 20 N/m.

2. The image forming apparatus of claim 1, wherein the layer thickness of the surface layer is in a range from 0.2 μm or more to 3 μm or less at a point 20 μm away from the leading-edge ridge line portion of the cleaning blade.

3. The image forming apparatus of claim 1, wherein the surface layer is formed by coating the strip shaped elastic blade with a coating including a solvent having a boiling point of 75 ° C. or less.

4. The image forming apparatus of claim 1, wherein the surface of the image carrier is not coated with a lubricant.

5. The image forming apparatus according of claim 1, wherein a Martens hardness of the surface layer is in a range from 50 $N/mm^2$ or more to 500 $N/mm^2$ or less.

6. The image forming apparatus of claim 1, wherein the surface layer is a thermosetting resin or a photosetting resin.

7. The image forming apparatus of claim 6, wherein the surface layer is formed of an acrylate material having a main skeleton of pentaerythritol triacrylate or dipentaerythritol hexaacrylate with a functional group number of 3 to 6 and at least a functional group equivalent weight molecular weight of 350 or less.

8. An image forming apparatus, comprising:

an image carrier;

a charging mechanism to charge a surface of the image carrier;

an electrostatic latent image forming mechanism to form an electrostatic latent image on the surface of the image carrier;

a developing mechanism to develop the electrostatic latent image formed on the surface of the image carrier into a toner image;

a transfer mechanism to transfer the toner image on the surface of the image carrier to a transfer body; and a cleaning mechanism including a cleaning blade to clean a transfer residue toner adhering to the surface of the image carrier by contacting the surface of the image carrier, wherein the cleaning blade includes a strip shaped elastic blade and a surface layer formed on an opposing surface of the strip shaped elastic blade, the opposing surface provided opposite the surface of the image carrier, and on a leading-edge surface, the leading-edge surface provided perpendicular to the opposing surface and sandwiches a leading-edge ridge line portion with the opposing surface, the surface layer having a hardness harder than the strip shaped elastic blade and a layer thickness becoming thicker as a distance from the leading-edge ridge line portion of the strip shaped elastic blade increases, and is formed up to the leading-edge ridge line portion, and wherein the leading-edge ridge line portion of the cleaning blade contacts the surface of the image carrier with an initial contact width between the cleaning blade and the surface of the image carrier in a range from 1 μm or more to 30 μm or less, and includes a linear pressure in a range from 7 N/m to less than 20 N/m.

9. A process cartridge, comprising:

an image carrier; and a cleaning mechanism including a cleaning blade to at least clean a transfer residue toner adhering to a surface of the image carrier, wherein the process cartridge supports the image carrier and the cleaning mechanism as a single unit, and is detachably attached with respect to a body of an image forming apparatus, wherein the cleaning blade includes a strip shaped elastic blade, and a surface layer formed on an opposing surface of the strip shaped elastic blade opposite the surface of the image carrier, the surface layer having a hardness harder than the strip shaped elastic blade and a layer thickness becoming thicker as a distance from a leading-edge ridge line portion of the strip shaped elastic blade increases, and is formed up to the leading-edge ridge line portion, and wherein the leading-edge ridge line portion of the cleaning blade contacts the surface of the image carrier with an initial contact width between the cleaning blade and the surface of the image carrier in a range from 12 μm or more to 30 μm or less, and includes a linear pressure in a range from 7 N/m to less than 20 N/m.

10. A process cartridge, comprising:

an image carrier; and a cleaning mechanism including a cleaning blade to at least clean a transfer residue toner adhering to a surface of the image carrier, wherein the process cartridge supports the image carrier and the cleaning mechanism as a single unit, and is detachably attached with respect to a body of an image forming apparatus, wherein the cleaning blade includes a strip shaped elastic blade, and a surface layer formed on an opposing surface of the strip shaped elastic blade, the opposing surface provided opposite the surface of the image carrier, and on a leading-edge surface, the leading-edge surface provided perpendicular to the opposing surface and sandwiches a leading-edge ridge line portion with the opposing surface, the surface layer having a hardness harder than the strip shaped elastic blade and a layer thickness becoming thicker as a distance from the leading-edge ridge line portion of the strip shaped elastic blade increases, and is formed up to the leading-edge ridge line portion, and wherein the leading-edge ridge line portion of the cleaning blade contacts the surface of the image carrier with an initial contact width between the cleaning blade and the surface of the image carrier in a range from 1 μm or more to 30 μm or less, and includes a linear pressure in a range from 7 N/m to less than 20 N/m.

* * * * *